US007160149B1

(12) United States Patent
Chawgo

(10) Patent No.: US 7,160,149 B1
(45) Date of Patent: Jan. 9, 2007

(54) COAXIAL CONNECTOR AND METHOD OF CONNECTING A TWO-WIRE CABLE TO A COAXIAL CONNECTOR

(75) Inventor: Shawn M. Chawgo, Liverpool, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 11/166,641

(22) Filed: Jun. 24, 2005

(51) Int. Cl.
*H01R 9/05* (2006.01)

(52) U.S. Cl. ..... 439/578; 439/656; 439/675

(58) Field of Classification Search ..... 439/578, 439/581, 583–585, 656, 675, 877, 879
See application file for complete search history.

(56) References Cited

U.S. PATENT DOCUMENTS

| | | | | |
|---|---|---|---|---|
| 3,846,738 A | | 11/1974 | Nepovim | |
| 4,053,196 A | * | 10/1977 | Dunaway | 310/68 R |
| 4,397,516 A | | 8/1983 | Koren et al. | 439/610 |
| 4,431,254 A | | 2/1984 | Cartesse | 439/610 |
| 4,688,878 A | | 8/1987 | Cohen et al. | |
| 4,869,690 A | | 9/1989 | Frear et al. | 439/675 |
| 4,927,385 A | | 5/1990 | Cheng | 439/578 |
| 5,151,053 A | | 9/1992 | Shinji et al. | 439/610 |
| 5,368,499 A | | 11/1994 | Hirt | 439/350 |
| 5,474,476 A | | 12/1995 | Cheng | 439/675 |
| 5,632,651 A | | 5/1997 | Szegda | 439/578 |
| 6,039,609 A | | 3/2000 | Hauver, Sr. et al. | 439/668 |
| 6,309,250 B1 | | 10/2001 | Hyzin | 439/578 |
| 6,398,584 B1 | | 6/2002 | Hua et al. | 439/578 |
| 6,530,807 B1 | | 3/2003 | Rodrigues et al. | 439/578 |
| 6,604,962 B1 | | 8/2003 | Eichmann et al. | 439/578 |
| 6,609,931 B1 | | 8/2003 | Parrish et al. | 439/578 |
| 6,716,062 B1 | | 4/2004 | Palinkas et al. | 439/578 |
| 6,733,336 B1 | | 5/2004 | Montena et al. | 439/578 |
| 6,767,247 B1 | | 7/2004 | Rodrigues et al. | 439/578 |
| 6,769,926 B1 | | 8/2004 | Montena | 439/253 |
| 6,780,052 B1 | | 8/2004 | Montena et al. | 439/578 |
| 6,808,415 B1 | | 10/2004 | Montena | 439/584 |
| 2002/0068483 A1 | | 6/2002 | Cruz et al. | 439/610 |
| 2004/0224552 A1 | * | 11/2004 | Hagmann et al. | 439/461 |

FOREIGN PATENT DOCUMENTS

| | | |
|---|---|---|
| EP | 190843 | 8/1986 |
| FR | 829590 | 6/1938 |

* cited by examiner

*Primary Examiner*—Michael C. Zarroli
(74) *Attorney, Agent, or Firm*—Wood, Phillips, Katz, Clark & Mortimer

(57) ABSTRACT

A coaxial connector having a connector assembly and a securing assembly. The connector assembly has a first contact assembly and a second contact assembly and first and second receivers for wire. The securing assembly and connector assembly cooperate with each other and are movable relative to each other so as to be changeable between a pre-assembly state and an assembled state. The first receiver is changeable from a first state into a second state wherein the first receptacle has a reduced effective diameter as an incident of the securing assembly and connector assembly being changed from the pre-assembly state into the assembled state.

38 Claims, 4 Drawing Sheets

PORT
CABLE
FIRST WIRE
SECOND WIRE
COMPRESSION TOOL 172

COAXIAL CONNECTOR AND METHOD OF CONNECTING A TWO-WIRE CABLE TO A COAXIAL CONNECTOR

BACKGROUND OF THE INVENTION

1. Field of the Invention

This invention relates to a coaxial connector that is connectable to a port and, more particularly, to a coaxial connector that electrically connects separate wires in a two-wire cable at the port. The invention is further directed to a method of connecting a two-wire cable to such a coaxial connector.

2. Background Art

Connecting ports for coaxial cable exist in many different environments and for many purposes. Typically, the port will have a male component that is electrically connected with a surrounding ground contact portion on the female portion of a coaxial connector. A conductive pin, centered within, and surrounded by, the ground contact portion, is brought into electrical contact with another conductive component that terminates at the port. As just examples, the connecting port may be at a drop or splice location.

In some applications, separate wires in a two-wire cable, often referred to as parallel conductors, a twisted pair, lamp cord, etc., are each electrically connected at the port to transmit signals, as between electronic devices. For example, a two-wire cable is often used to transmit audio signals from a CD player to a receiver. Thus, it is common to electrically connect the two-wire cable at such a port using a coaxial connector.

Many different techniques have been devised to attach a two-wire cable to a coaxial connector for attachment in turn at a port. Generally, these techniques have been relatively labor intensive. It is known to maintain these electrical connections by soldering, as shown for example in U.S. Pat. No. 4,397,516, to Koren et al. U.S. Pat. No. 6,039,609, to Hauver, Sr. et al, discloses electrical connections maintained through "seizure screws". These types of connections require extra components and assembly steps that potentially account for longer installation times. Additionally, the integrity of the connections may be different, from one to the next, depending upon the care taken by the installer.

Further, some of these prior art connectors are made with an extended construction in both axial and radial directions to accommodate the components required to effect the electrical connections. Dimensional control is almost always a goal in the design of these components.

Ideally, a coaxial connector would be provided that would allow efficient and consistently high integrity connections to be made between a port and a two-wire cable, without requiring any significant dimensional increase over conventional coaxial connectors used for joining coaxial cable to such a port.

SUMMARY OF THE INVENTION

In one form, the invention is directed to a coaxial connector having a connector assembly and a securing assembly. The connector assembly has a first axis and axially spaced first and second ends. The connector assembly further has a first contact assembly and a second contact assembly. The connector assembly has a first receiver having a first state in which the first receiver defines a first receptacle for a first wire with a first effective diameter. A first conductor on the first wire is electrically connected to the first contact assembly with the first wire in operative engagement with the connector assembly. The connector assembly has a second receiver having a first state in which the second receiver defines a second receptacle for a second wire with a second effective diameter. A second conductor on the second wire is electrically connected to the second contact assembly with the second wire in operative engagement with the connector assembly. The securing assembly and connector assembly cooperate with each other and are movable relative to each other so as to be changeable between a pre-assembly state and an assembled state. The first receiver is changeable from the first state into a second state, wherein the first receptacle has a third effective diameter that is less than the first effective diameter as an incident of the securing assembly and connector assembly being changed from the pre-assembly state into the assembled state. The first wire in operative engagement with the connector assembly is held more securely in the first receptacle with the first receiver in the second state than with the first receiver in its first state.

The coaxial connector may be provided in combination with a two-wire cable having first and second wires.

In one form, the second receiver is changeable from its first state into a second state wherein the second receptacle has a fourth effective diameter that is less than the second effective diameter as an incident of the securing assembly and connector assembly being changed from the pre-assembly state into the assembled state. The second wire in operative engagement with the connector assembly is held more securely in the second receptacle with the second receiver in its second state than with the second receiver in its first state.

In one form, the first receptacle has a second axis that is substantially parallel to the first axis and the first receiver is in the form of a first collet with a first wall extending around a substantial portion of the first receptacle.

In one form, the securing assembly has a first crimping passage having a third axis that is substantially parallel to the second axis. The first collet is extendable into the first crimping passage and progressively radially compressed relative to the second axis within the first crimping passage to progressively reduce the effective diameter of the first receptacle as the securing assembly and connector assembly are changed between the pre-assembled state and the assembled state.

In one form, the first receptacle has a stepped effective diameter with a larger effective diameter portion to receive a part of the first wire with an insulating layer around a first conductor, and a smaller effective diameter portion to receive a part of the first wire with the insulating layer removed. The larger and smaller effective diameter portions are both reduced in effective diameter as an incident of the securing assembly and connector assembly being changed from the pre-assembly state into the assembled state so that both parts of the first wire are held more securely in the first receptacle with the first receiver in its second state than with the first receiver in its first state.

In one form, the first wall has a non-smooth surface that digs into the first wire with the first wire in operative engagement with the connector assembly and with the first receiver in its second state.

In one form, the first wall on the collet has a slot therein to facilitate radial repositioning of a part of the first wall on the collet relative to the second axis as the first receiver is changed from its first state into its second state.

In one form, the second receptacle has a fourth axis that is substantially parallel to the first and second axes and the second receiver has a second collet with a second wall extending around a substantial portion of the second receptacle.

In one form, the securing assembly and connector assembly are translatable relative to each other substantially along the first axis as the securing assembly and connector assembly are changed from the pre-assembly state into the assembled state.

In one form, there are surfaces on the securing assembly and connector assembly that face radially oppositely relative to the first axis and cooperate to guide relative movement between the receiving assembly and connector assembly as the securing assembly and connector assembly are changed between the pre-assembly and assembled states.

In one form, the securing assembly has a first shoulder facing in one axial direction relative to the first axis and the connector assembly has a second shoulder facing oppositely to the first shoulder. The first and second shoulders are configured to be engaged by a tool that draws the first and second shoulders towards each other to thereby change the securing assembly and connector assembly from the pre-assembly state into the assembled state.

In one form, the securing assembly has first and second spaced crimping passages to receive the first and second collets, respectively. The crimping passages are bounded by first and second walls having tapered first and second surfaces that act against the first and second collets to a) change the first receiver from its first state into its second state and b) change the second receiver from its first state into a second state, wherein the second receptacle has a fourth effective diameter that is less than the second effective diameter, as an incident of the securing assembly and connector assembly being changed from the pre-assembly state into the assembled state.

In one form, the radially oppositely facing surfaces on the receiving assembly and connector assembly frictionally wedge together to maintain the securing assembly and connector assembly in a desired relationship along the first axis.

In one form, the securing assembly and connector assembly have cooperating shoulders that face axially relative to the first axis and abut to prevent separation of the securing assembly and connector assembly with the securing assembly and connector assembly in the pre-assembly state.

In one form, the connector assembly has a cylindrical body with a wall bounding an internal receptacle and an insulator relative to which at least one of the first and second receivers is fixed.

In one form, the first contact assembly has a first ground contact surface that extends around the first axis for surrounding and electrically connecting to a male port to which the coaxial connector is operatively engaged. The first receiver has a first lead that extends through a substantial distance around the first axis and is electrically connected to the first ground contact surface.

In one form, the first lead is captive between the insulator and a conductive part of the wall of the cylindrical body to thereby make electrical connection between the first lead and the first ground contact surface.

In one form, the second contact assembly includes a pin that is surrounded by the first contact assembly. A second lead electrically connects between the second receiver and the pin.

In one form, at least a part of each of the first and second receivers and the first and second leads is embedded in the insulator so that the insulator and a) first and second receivers and b) first and second leads are movable as a self-contained unit relative to the cylindrical body.

In one form, the self-contained unit can be assembled to the cylindrical body by relatively moving the self-contained unit and cylindrical body guidingly, one against the other, along the first axis.

In one form, the insulator has a stepped diameter that conforms to an inside surface of the wall bounding the internal receptacle.

In one form, the radially oppositely facing surfaces on the securing assembly and connector assembly frictionally wedge together with a force that increases as the securing assembly and connector assembly are changed between the pre-assembly state and assembled state.

In one form, the cylindrical body and insulator are keyed to each other to confine relative pivoting between the cylindrical body and insulator around the first axis.

In one form, there is a single piece that defines both of the first and second crimping passages.

The invention is further directed to a coaxial connector having a connector assembly and a securing assembly. The connector assembly has a first axis and axially spaced first and second ends. The connector assembly has a first contact assembly and a second contact assembly for electrical connection to a port. The connector assembly further has first and second receivers with first and second receptacles and first and second conductors, respectively. Structure is provided for electrically connecting the first and second conductors respectively to the first and second contact assemblies. The connector assembly and securing assembly include cooperating structure for crimping first and second wires in electrical contact with the first and second conductors in the first and second receptacles in response to relative movement of at least a part of the securing assembly relative to at least a part of the connector assembly, to thereby change the securing assembly and connector assembly between a pre-assembly state and an assembled state.

In one form, the at least part of the securing assembly and connector assembly are relatively movable in translation along a line that is substantially parallel to the first axis to change the securing assembly and connector assembly from the pre-assembly state into the assembled state.

In one form, the connector assembly includes an insulator and a cylindrical body. Structure cooperates between the insulator and cylindrical body for allowing press connecting of the insulator and cylindrical body.

The coaxial connector may be provided in combination with a two-wire cable having the first and second wires.

The invention is further directed to a method of connecting a two-wire cable having first and second wires to a coaxial connector. The method includes the steps of: providing a coaxial connector having a) a connector assembly with a first contact assembly and a second contact assembly and first and second conductors electrically connected respectively to the first and second contact assemblies, and b) a securing assembly; placing the first wire in electrical contact with the first conductor and the second wire in electrical contract with the second conductor; and moving at least a part of the securing assembly relative to the connector assembly to thereby change the securing assembly and connector assembly from a pre-assembly state into an assembled state as an incident of which the first and second wires are crimped and maintained in operative engagement with the first and second conductors on the connector assembly.

The method may further include the step of directing the first and second wires one each through first and second crimping passages defined by the securing assembly before changing the securing assembly and connector assembly from the pre-assembly state into the assembled state.

The first and second wires may each have a conductor with an insulating layer. The method may further include the step of removing the insulating layers from the wires after the wires are directed through the crimping passages.

The step of providing a coaxial connector may involve providing a coaxial connector with a connector assembly having first and second receivers with first and second receptacles, each having an effective diameter. The method may further include the steps of directing the first wire into the first receptacle and the second wire into the second receptacle and reducing the effective diameters of the first and second receptacles as an incident of changing the securing assembly and connector assembly from the pre-assembly state into the assembled state.

The step of providing a coaxial connector may involve providing an insulator, first and second receivers, and first and second leads electrically connected one each to the first and second receivers, assembling the insulator and first and second leads and receivers as a self-contained unit, providing a cylindrical body with an internal receptacle, and directing the self-contained unit into the internal receptacle so that the first and second leads are respectively brought into electrical contact with the first and second contact assemblies.

In one form, the securing assembly has a first shoulder and the connector assembly has a second shoulder. The method may further include the step of causing the first and second shoulders to abut to prevent separation of the securing assembly and connector assembly with the securing assembly and connector assembly in the pre-assembly state.

In one form, the securing assembly and connector assembly have facing surfaces. The method may further include the step of causing the facing surfaces to frictionally wedge together to maintain the securing assembly and connector assembly together as an incident of changing the securing assembly and connector assembly from the pre-assembly state into the assembled state.

The method may further include the step of using a tool to engage the parts of the securing assembly and connector assembly and to translate the part of the securing assembly to thereby change the securing assembly and connector assembly from the pre-assembly state into the assembled state.

The step of moving at least a part of the securing assembly relative to the connector assembly may involve translating a part of the securing assembly relative to the connector assembly to thereby change the securing assembly from the pre-assembly state into the assembled state.

DETAILED DESCRIPTION OF THE DRAWINGS

Figure 1:
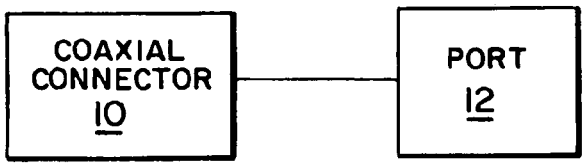
FIG. 1 is a schematic representation of a coaxial connector, according to the present invention, operatively electrically/mechanically connected to a port.

In FIG. 1, a coaxial connector, according to the present invention, is shown at 10 electrically/mechanically connected to a port 12. The port 12 may be associated with any system or component to/from which an electrical signal is supplied. Typically, the port 12 will be designed to translatingly, or otherwise, accept a conventional-type coaxial connector, having a cylindrical ground contact element and a line contact, typically in the form of a pin. The nature of the signal or signals transmitted through the coaxial connector 10 is not critical to the present invention.

Figure 2:
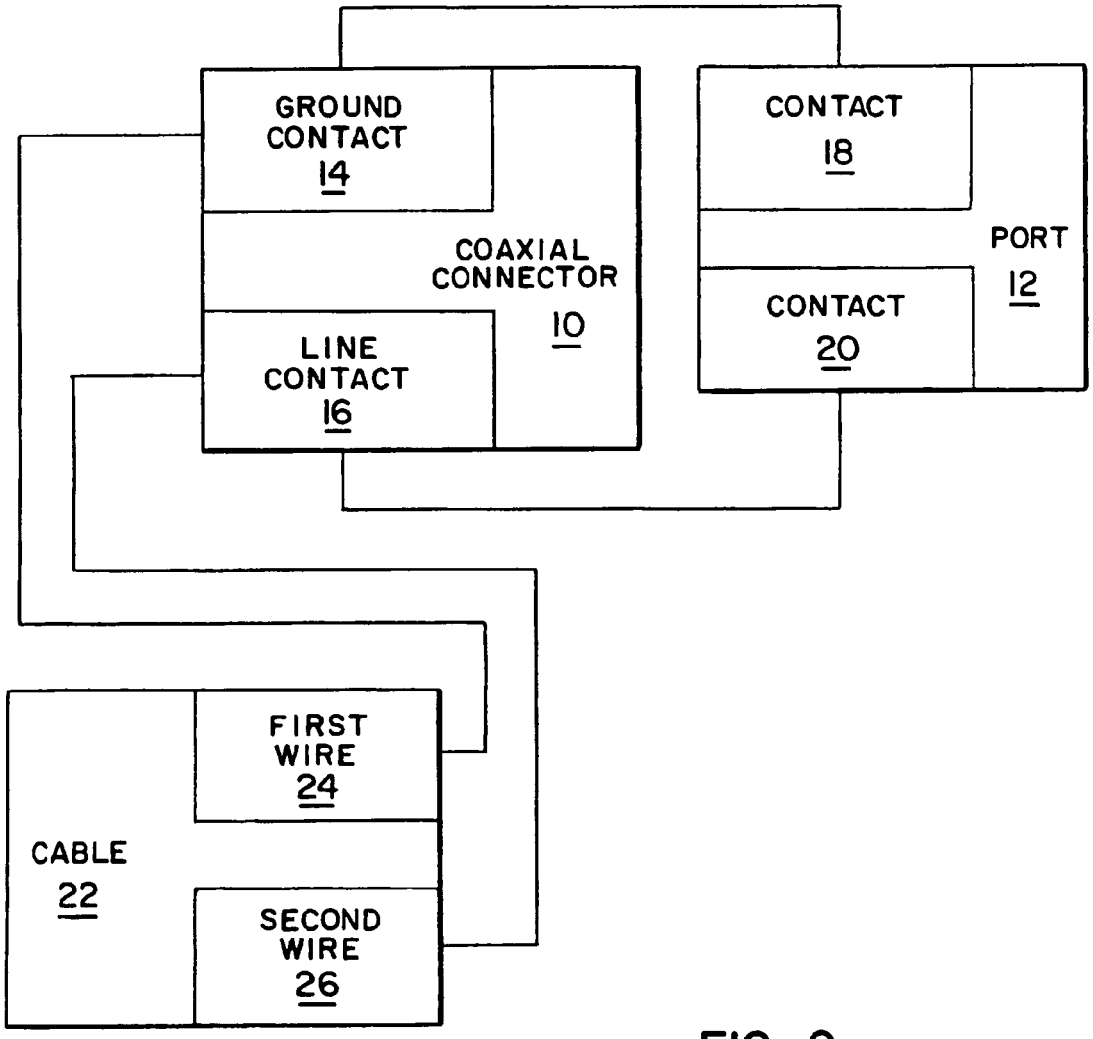
FIG. 2 is a schematic representation of the coaxial connector of FIG. 1 connected to a port and with a two-wire cable connected to the coaxial connector.

A more specific depiction of the coaxial connector 10 is shown in FIG. 2, with the aforementioned ground contact element 14 and line contact/pin 16. The port 12 is shown with a contact 18 that is electrically connected to the ground contact 14, and a separate contact 20, electrically connected to the line contact 16.

The invention is concerned primarily with the electrical connection of a cable 22 with the coaxial connector 10. As noted above, the precise nature and configuration of the ground and line contacts 14, 16, which cooperate with the port 12, are not critical to the present invention. The invention is particularly concerned with the connection of the cable 22 that is in the form of a two-wire cable, commonly additionally referred to as a twisted pair cable, a biaxial cable, lamp cord, etc. Essentially, the cable 22 has discrete first and second wires 24, 26 that are electrically connected to the contacts 18, 20 through the ground contact 14 and line contact 16.

More specific details of the coaxial connector will now be described with respect to FIGS. 3–6. The coaxial connector 10 consists of a connector assembly 30 and a securing assembly 32. The connector assembly 30 has a first, central axis 34 and axially spaced first and second ends 36, 38.

The connector assembly 30 has a first contact assembly at 40 and a second contact assembly 42. The first contact assembly 40 is defined by an axially slotted, cylindrical wall 44 with its inside defining the annular ground contact surface 14 that extends a substantial distance around the first axis 34 and, in this embodiment, substantially fully therearound, with the exception of the region at which the cylindrical wall 44 is slotted. The central axis of the cylindrical wall 44 is substantially coincident with the first axis 34.

The ground contact surface 14 is shown to be smooth so that the cylindrical wall 44 can be translated guidingly relative to a threaded or unthreaded male component on the port 12, to make electrical connection with the contact 18, previously described. As previously noted, this ground contact surface 14 could be threaded to effect connection with a threaded port surface.

The second contact assembly 42 includes the conductive pin 16, which has a cylindrical shape with a central axis that is substantially coincident with the first axis 34 and the central axis of the wall 44. The pin 16 extends through a space 50 bounded by the cylindrical wall 44 so as to be exposed for connection within the space 50 to the contact 20 on the port 12.

The connector assembly 30 further consists of a first receiver 52 having a first state, as shown in FIGS. 3–6, in which the first receiver 52 defines a first receptacle 54 for the first wire 24 with a first effective diameter D. The first receiver 52 has a wall 56 with an inside surface/conductor 58 that electrically connects the first wire 24 to the first contact assembly 40, with the first wire 24 in operative engagement with the connector assembly. As will be explained in greater detail below, the first receiver 52 has an associated first lead 60 that is electrically connected to the first contact assembly 40 through a cylindrical body 62 on which the first contact assembly 40 is defined.

The connector assembly 30 includes a second receiver 64 with a wall 66 with an inside surface/conductor 68 bounding a receptacle 70. The second receiver 64 has a first state, as shown in FIGS. 3–6, in which the receptacle 70 defined thereby for the second wire 26 has a second effective diameter. Through the inside surface/conductor 68 on the second receiver 64, the second wire 26 is electrically connected to the second contact assembly 42, with the second wire in operative engagement with the connector assembly 30. A second lead 72 electrically connects between the second receiver 64 and the second contact assembly 42.

In the embodiment shown, the first and second receivers 52, 64 are generally cylindrical in shape and have central axes that are substantially parallel to each other, the central axis for the conductive pin 16, and the first axis 34 for the connector assembly 30. The central axes for the first and second receivers 52, 64 are radially offset from each other and the first axis 34 in the embodiment shown.

The wall 56 of the first receiver 52 has axially extending slots 74 formed at circumferentially spaced locations to define radially deflectable blades 76, whereby the first receiver 52 functions as a collet. The second receiver 64 has similar slots 78 defining flexible blades 80, whereby the second receiver 64 likewise functions as a collet.

Figure 8:
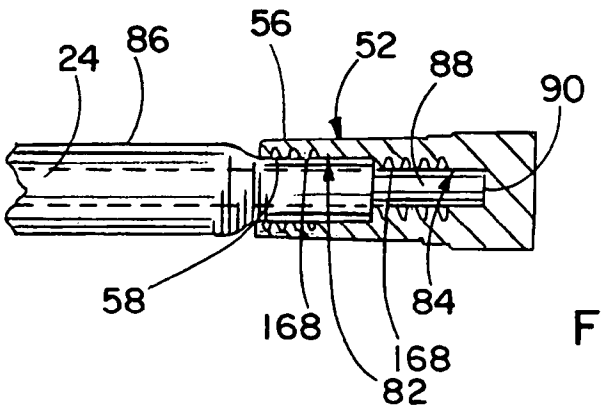
FIG. 8 is a fragmentary, cross-sectional view of a connection between a receiver/collet on the connector assembly and a wire, with the connector assembly and securing assembly in the assembled state.

The first and second receivers/collets 52, 64 are shown with the same construction and dimensions, though this is not a requirement. Details of the exemplary first receiver/collet 52 are additionally shown in FIG. 8. The wall 56 thereof is configured so that the inside surface/conductor 58 defining the effective diameter D for the receptacle 54, is preferably stepped with a larger effective diameter portion 82 and a smaller effective diameter portion 84. The larger effective diameter portion 82 is designed to receive a part of the first wire 24 that has an insulating layer 86 disposed around a conductor/core wire 88. A part of the first wire 24 at the leading end 90 is stripped to expose the conductor/core wire 88, thereby reducing the diameter of the first wire 24 thereat. Consequently, as seen in FIG. 8, the inside surface/conductor 58 is stepped generally conformingly to the wire 24 where the wire has a stepped outer circumference by reason of having the insulating layer 86 stripped.

The first and second receivers/collets 52, 64, first and second leads 60, 72, and second contact assembly 42 are combined with an insulator 92 to produce a self-contained unit 94 that can be assembled with the cylindrical body 62 to complete the connector assembly 30.

The insulator 92 has a stepped diameter outer surface 96 that conforms to an inside surface 98 on the cylindrical body 62 bounding an internal receptacle 100 within which the insulator 92 resides with the insulator 92 and cylindrical body 62 operatively connected. The wall 102 defining the inside surface 98 is made partially or entirely from a conductive material.

Figures 3, 4:
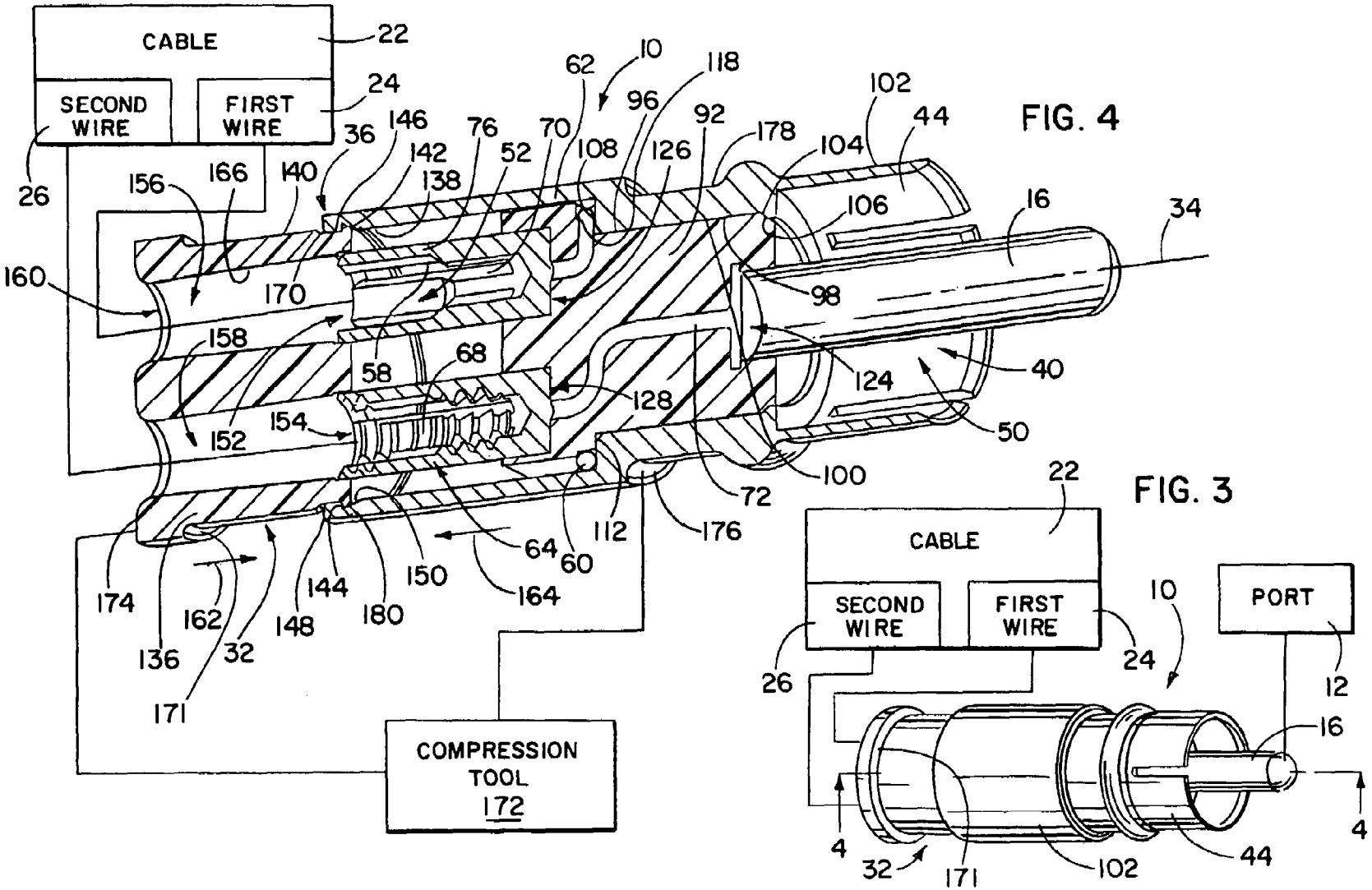
FIG. 3 is a partially schematic, perspective view of the coaxial connector of FIG. 1 to which a two-wire cable is operatively connected and with the coaxial connector mechanically/electrically connected to a port.
FIG. 4 is an enlarged, cross-sectional view of the coaxial connector taken along line 4—4 of FIG. 3.
Figure 5:
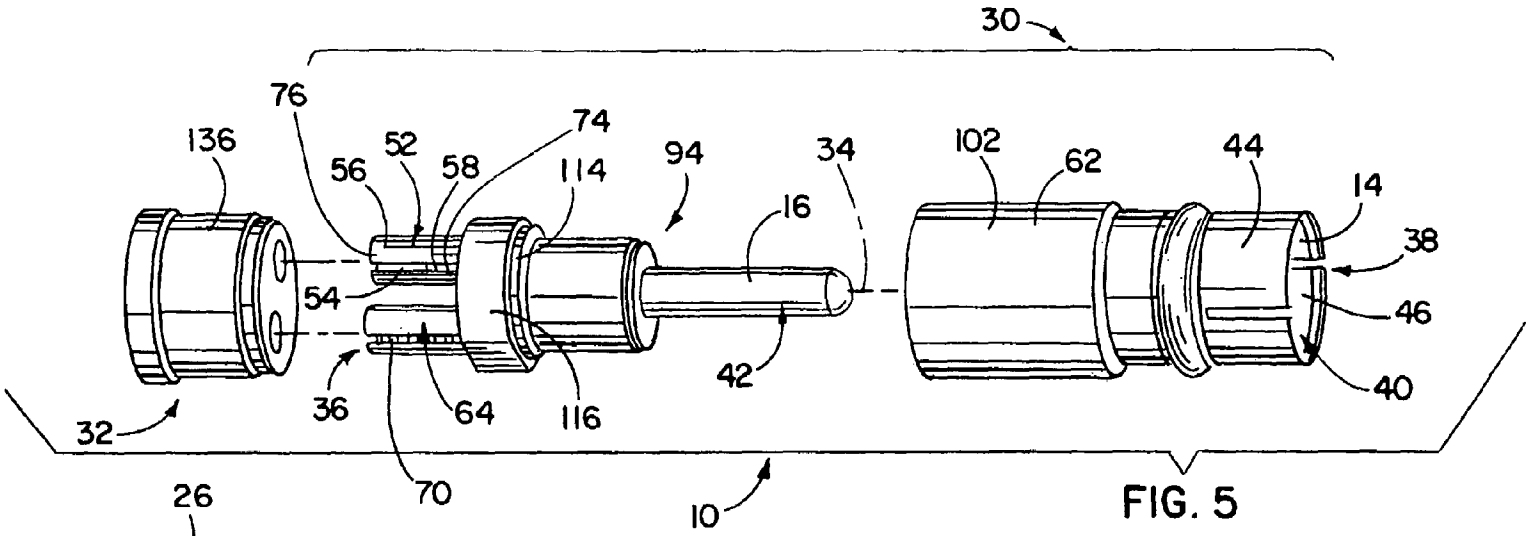
FIG. 5 is an exploded perspective view of the coaxial connector in FIGS. 3 and 4.
Figure 6:
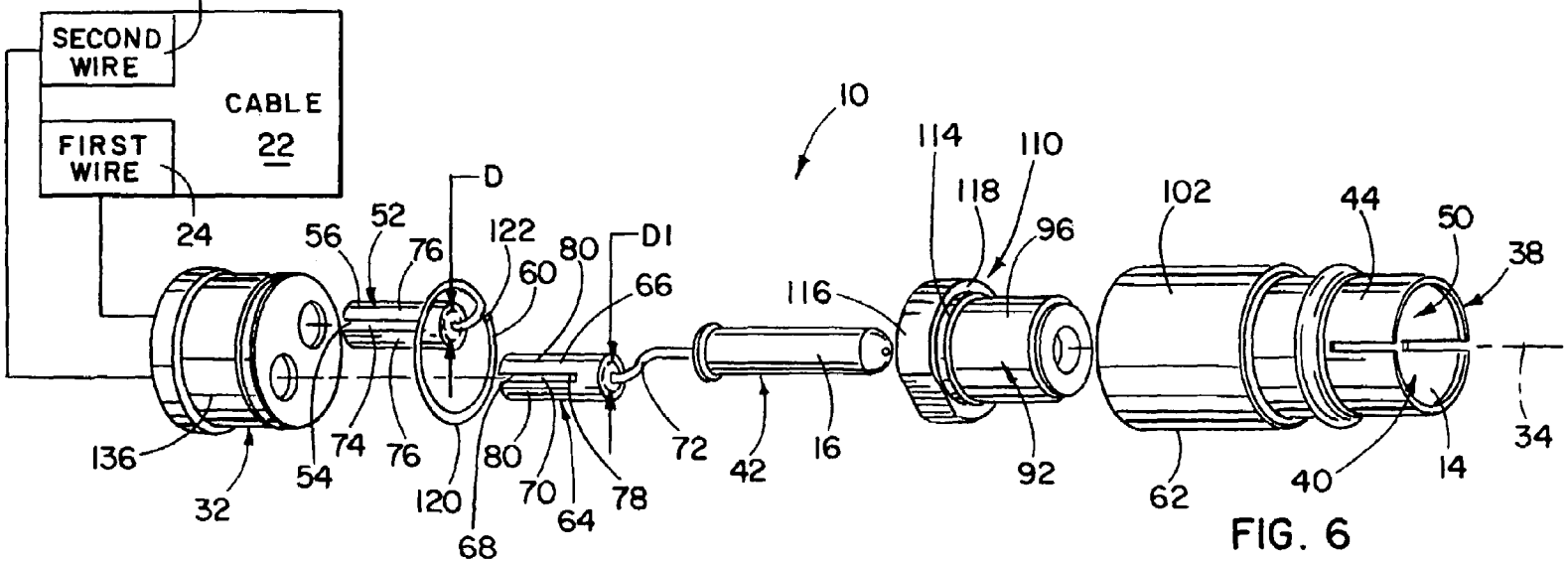
FIG. 6 is a view as in FIG. 5 with additional parts exploded.

The stepped, outer surface 96 of the insulator 92 and inside surface 98 of the cylindrical body 62 are movable guidingly, one against the other, as the self-contained unit 94 and cylindrical body 62 are axially aligned as in FIG. 5 and, from there, moved axially one towards the other into assembled relationship, as shown in FIG. 4. With the self-contained unit 94 and cylindrical body 62 fully assembled, an annular shoulder 104 on the insulator 92 abuts a shoulder 106 on the wall 102 of the cylindrical body 62 so that the self-contained unit 94 and cylindrical body 62 are consistently placed in assembled relationship.

By reason of the stepped diameter of the inside surface 98 on the cylindrical body 62, an annular, axially facing shoulder 108 is defined facing the first axial end 36 of the connector assembly 30. A corresponding annular step 110 on the insulator 92 produces an annular, axially facing shoulder 112 that abuts to the shoulder 108, simultaneously as the shoulders 104, 106 interact.

The outer surface 96 is further configured to define an annular, radially outwardly facing seat 114 that is radially offset from, and adjacent to, the largest diameter portion 116 of the surface 96. The first lead 60 wraps around the seat 114 and is exposed between the shoulder 108 on the cylindrical body 62 and a facing shoulder 118 on the insulator 92. With the self-contained unit 94 fully assembled with the cylindrical body 62, a ring-shaped portion 120 of the first lead 60 is captively squeezed between the insulator shoulder 118 and cylindrical body shoulder 108 so as to be maintained in electrical contact with the shoulder 108, through which a conductive path to the ground contact surface 14 is established. The ring-shaped portion 120 extends in an arcuate shape through a substantial distance around the axis 34. In this embodiment, a free end 122 of the ring-shaped portion 120 is slightly spaced from the first lead 60 at a location where it departs from the first receiver/collet 52, whereby the ring-shaped portion 120 extends through almost 360°. This assures that electrical contact will be positively maintained between the first lead 60 and the shoulder 108, and therethrough to the ground contact surface 14.

The second lead 72 and a base portion 124 of the conductive pin 16 are embedded in the insulator 92 so as to maintain the axial orientation of the conductive pin 16, which is centered within the space 50. Base portions 126, 128 of the first receiver/collet 52 and second receiver/collet 64, respectively, are likewise embedded in the insulator 92 to maintain a desired location and orientation thereof on the self-contained unit 94.

The nature of the insulator 92 is not critical to the present invention. For example, the insulator 92 may be made with a solid construction or may be hollow in nature. A suitable material to construct the insulator from is, for example, Delrin® plastic.

The insulator 92 can be molded around the portions of the first receiver/collet 52, second receiver/collet 64, leads 60, 72 and conductive pin 16, or may be otherwise suitably mated therewith to preferably define a self-contained unit 94 that can be joined to the cylindrical body 62 while maintaining the orientation and spacing of these components. However, there is no requirement for the self-contained unit 94 or that the insulator 92 be molded around the components.

The securing assembly 32 has a body 136 that has a generally cylindrical shape designed to telescopingly engage with the inside surface 98 of the cylindrical body 62 at the first axial end 36 of the connector assembly 30. In this embodiment, the cylindrical body 62 has a radially inwardly facing surface portion 138 that surrounds a radially outwardly facing surface 140 on the body 136.

The securing assembly 32 and connector assembly 30 are maintained in a pre-assembly state, as shown in FIG. 4, through axially facing, annular shoulders 142, 144 on the cylindrical body 62 and body 136. The shoulder 144 on the body 136 is defined by an annular undercut 146 defining an annular ramp surface 148. The shoulder 142 is defined by a groove 150 projecting radially outwardly from the surface portion 138.

With the connector assembly 30 and securing assembly 32 in the pre-assembly state of FIG. 4, the first and second receivers/collets 52, 64 respectively align at entry ends 152, 154 of first and second crimping passages 156, 158.

Exemplary crimping passage 156 tapers in diameter from the entry end 152 progressively towards the opposite end 160. The crimping passage 156 extends fully through the body 136.

By axially shifting the connector assembly 30 and securing assembly 32 from the pre-assembly state towards each other, as indicated by the arrows 162, 164, the surface 166 bounding the passage 156 bears on the blades 76 on the first receiver/collet 52, thereby progressively reducing the effective diameter of the receptacle 70 bounded thereby. With the first wire 24 extending through the passage 156 and into the receptacle 70, as shown clearly in FIG. 8, and the connector assembly 30 and securing assembly 32 changed from the pre-assembly state of FIG. 4 into the assembled state of FIG. 7, the first wire 24 is seized. This causes the blades 76 to be deflected radially inwardly to mechanically grip the insulating layer 86 and mechanically and electrically grip the conductor/core wire 88. Thus a secure mechanical and electrical connection is established between the first receiver/collet 52 and the first wire 24. The second wire 26 is similarly connected to the second receiver/collet 64, with the blades 80 being deflected radially inwardly to effect seizing of the wire 26 as they pass through the second crimping passage 158.

The inside surface/conductor 58 on the first receiver/collet 52 may be smooth but is more preferably irregularly shaped, as to form projections 168 that are caused to "dig in" to the insulating layer 86 and conductor/core wire 88. This establishes even more positive electrical and mechanical connection.

In this embodiment, the body 136 may be made from an insulating material, such as Delrin® plastic. The body 136 may be molded so that a single piece defines both of the passages 156, 158.

Figure 7:
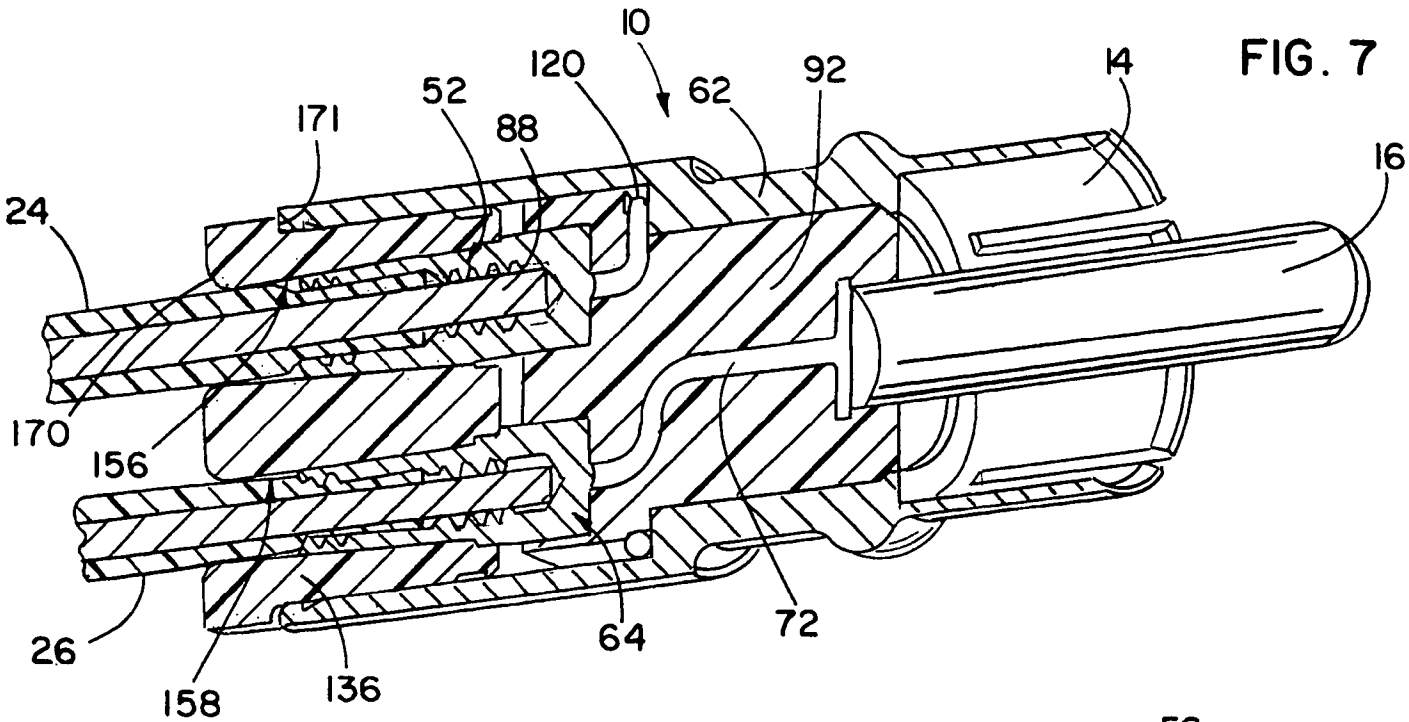
FIG. 7 is a view as in FIG. 4 wherein the connector and securing assemblies are changed into an assembled state.

As the connector assembly 30 and securing assembly 32 are relatively movable between the pre-assembly state, shown in FIG. 4, and the assembled state, shown in FIG. 7, the radially facing surfaces 138, 140 cooperate to both guide this relative movement and also to effect a frictional wedging action that maintains the connector assembly 30 and securing assembly 32 in the assembled state. The assembled state actually is any relative position throughout a range of relative positions for the connector and securing assemblies 30, 32, within which a sufficient crimping force is produced and maintained upon the first receiver/collet 52 and second receiver/collet 64.

More particularly, as the connector assembly 30 and securing assembly 32 are moved in the direction of the arrows 162, 164 from the pre-assembly state in FIG. 4, a rounded, annular nose 170 on the cylindrical body 62 is guided up the ramp surface 148. A slight deformation of the body 136 and/or cylindrical body 62 is caused to allow this initial relative movement. This deformation generates residual restoring forces in the body 136 and cylindrical body 62.

Continued relative movement increases this wedging force by reason of the increase in surface contact area between the radially facing and cooperating surfaces 138, 140. Additionally, the surface 140 may increase in diameter towards the end 160 of the body 136. As a result, the wedging force progressively increases as the connector assembly 30 and securing assembly 32 are relatively moved in the direction of the arrows 162, 164. This relative movement is limited by a shoulder 171 that ultimately may abut to the cylindrical body 62 at the axial end 36 of the connector assembly 30.

To effect this relative movement between the connector and securing assemblies 30, 32, a conventional compression tool 172 can be employed. The compression tool 172 acts between shoulders 174, 176, respectively at the end of the body 136 and bounding an external undercut 178 on the cylindrical body 62.

While the receptacles 54, 70 defined by the first receiver/collet 52 and second receiver/collet 64 are shown as generally cylindrical, this is not a requirement. Regardless of the shape of each receptacle, the receptacle will have a first effective diameter with the connector and securing assemblies 30, 32 in the pre-assembly state. By relatively moving the connector assembly 30 and securing assembly 32 to the assembled state, the first receiver/collet 52 and second receiver/collet 64 are crimped to thereby each be changed to a second state wherein the effective diameter of the receptacles 54, 70 is reduced from the diameter in the first states therefor. As the receptacles 54, 70 are reduced in diameter, the wires 24, 26, in operative engagement with the connector assembly 30, are held more securely and a more positive electrical connection is maintained. As this crimping occurs, preferably both the larger and smaller effective diameter portions of the receptacles 54, 70 reduce in size to accomplish this.

With the above described structure, the two-wire cable can be conveniently, consistently, and effectively both mechanically and electrically operatively engaged with the coaxial connector 10.

Figure 9:
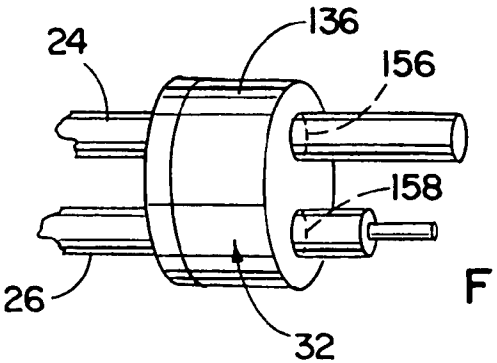
FIG. 9 is a perspective view of the securing assembly with the leading ends of the wires projecting therethrough preparatory to effecting stripping thereof.

The above-described structure lends itself to assembly in several different manners. In one exemplary procedure, the first and second wires 24, 26 are directed through the passages 156, 158 to be exposed at the entry ends 152, 154 thereof. The wires 24, 26 can be stripped before being directed through the passages 156, 158 in the body 136 of the securing assembly 32, or after this is accomplished, with the latter process being shown in FIG. 9 wherein the leading ends of the wires 24, 26 are projected through the passages 156, 158, respectively, with the wire 26 stripped and the wire 24 positioned to be stripped. The body 136 can then be snap fit to the connector assembly 30 to realize the pre-assembly state in FIG. 4. This is facilitated by providing an annular ramp surface 180 that cooperates with the annular nose 170 on the cylindrical body 62 to allow deformation of the body 136 and/or cylindrical body 62 sufficiently in the radial direction to allow the shoulders 142, 144 to move axially past each other by simple translational movement between the connector and securing assemblies 30, 32. Once the pre-assembly state is realized, the deformed cylindrical body 62 and/or body 136 tend back towards an undeformed state wherein the shoulders 142, 144 radially overlap and confront each other.

The leading ends of the wires 24, 26 can then be pressed fully into the receptacles 54, 70 by directing the leading ends along the first axis 34 in a first direction after which the connector assembly 30 and securing assembly 32 can be changed from the pre-assembly state into the assembled state by moving the securing assembly 32 along the first axis relative to the connector assembly 30 in the same first direction as the leading ends of the wires 24, 26 are moved in being pressed into the receptacles 54, 70. The invention contemplates that only a part of each of the connector assembly 30 and securing assembly 32 need be relatively movable to change the connector and securing assemblies 30, 32 from their pre-assembly states into their assembled states. While translational movement between the connector and receiving assemblies 30, 32 is described, other relative movement is contemplated to change the state of these assemblies 30, 32.

The foregoing disclosure of specific embodiments is intended to be illustrative of the broad concepts comprehended by the invention.

The invention claimed is:

1. A coaxial connector comprising:

a connector assembly having a first axis and axially spaced first and second ends, the connector assembly comprising a first contact assembly and a second contact assembly, the connector assembly further comprising: a) a first receiver having a first state in which the first receiver defines a first receptacle for a first wire with a first effective diameter, a first conductor on the first wire electrically connected to the first contact assembly with the first wire in operative engagement with the connector assembly and b) a second receiver having a first state in which the second receiver defines a second receptacle for a second wire with a second effective diameter, a second conductor on the second wire electrically connected to the second contact assembly with the second wire in operative engagement with the connector assembly; and a securing assembly, the securing assembly and connector assembly cooperating with, and movable relative to, each other so as to be changeable between a pre-assembly state and an assembled state, the first receiver changeable from its first state into a second state wherein the first receptacle has a third effective diameter that is less than the first effective diameter as an incident of the securing assembly and connector assembly being changed from the pre-assembly state into the assembled state, the first wire in operative engagement with the connector assembly held more securely in the first receptacle with the first receiver in the second state than with the first receiver in its first state.

2. The coaxial connector according to claim 1 in combination with a two-wire cable comprising the first and second wires.

3. The coaxial connector according to claim 1 wherein the second receiver is changeable from its firs/t state into a second state wherein the second receptacle has a fourth effective diameter that is less than the second effective diameter as an incident of the securing assembly and connector assembly being changed from the pre-assembly state into the assembled state, the second wire in operative engagement with the connector assembly held more securely in the second receptacle with the second receiver in its second state than with the second receiver in its first state.

4. The coaxial connector according to claim 1 wherein the first receptacle has a second axis that is substantially parallel to the first axis and the first receiver comprises a first collet with a first wall extending around a substantial portion of the first receptacle.

5. The coaxial connector according to claim 4 wherein the securing assembly comprises a first crimping passage having a third axis that is substantially parallel to the second axis, the first collet is extendable into the first crimping passage and progressively radially compressed relative to the second axis within the first crimping passage to progressively reduce the effective diameter of the first receptacle as the securing assembly and connector assembly are changed between the pre-assembly state and the assembled state.

6. The coaxial connector according to claim 4 wherein the first receptacle has a stepped effective diameter with a larger effective diameter portion to receive a part of a first wire with an insulating layer around a first conductor, and a smaller effective diameter portion to receive a part of the first wire with the insulating layer removed, the larger and smaller effective diameter portions both reduced in effective diameter as an incident of the securing assembly and connector assembly being changed from the pre-assembly state into the assembled state so that both parts of the first wire are each held more securely in the first receptacle with the first receiver in the second state than with the first receiver in its first state.

7. The coaxial connector according to claim 4 wherein the first wall has a non-smooth surface that digs into a first wire in operative engagement with the connector assembly and with the first receiver in the second state.

8. The coaxial connector according to claim 4 wherein the first wall on the first collet has a slot therein to facilitate radial repositioning of a part of the first wall on the collet relative to the second axis as the first receiver is changed from its first state into the second state.

9. The coaxial connector according to claim 4 wherein the second receptacle has a fourth axis that is substantially parallel to the first and second axes and the second receiver comprises a second collet with a second wall extending around a substantial portion of the second receptacle.

10. The coaxial connector according to claim 1 wherein the securing assembly and connector assembly are translatable relative to each other substantially along the first axis as the securing assembly and connector assembly are changed from the pre-assembly state into the assembled state.

11. The coaxial connector according to claim 10 wherein there are surfaces on the securing assembly and connector assembly that face radially oppositely relative to the first axis and cooperate to guide relative movement between the securing assembly and connector assembly as the securing assembly and connector assembly are changed between the pre-assembly and assembled states.

12. The coaxial connector according to claim 11 wherein the securing assembly has a first shoulder facing in one axial direction relative to the first axis and the connector assembly has a second shoulder facing oppositely to the first shoulder, the first and second shoulder configured to be engaged by a tool that draws the first and second shoulders towards each other to thereby change the securing assembly and connector assembly from the pre-assembly state into the assembled state.

13. The coaxial connector according to claim 9 wherein the securing assembly has first and second spaced crimping passages to receive the first and second collets respectively and bounded by first and second walls, the first and second walls have tapered first and second surfaces that act against the first and second collets to a) change the first receiver from its first state into its second state and b) change the second receiver from its first state into a second state wherein the second receptacle has a fourth effective diameter that is less than the second effective diameter, as an incident of the securing assembly and connector assembly being changed from the pre-assembly state into the assembled state.

14. The coaxial connector according to claim 11 wherein the radially oppositely facing surfaces on the securing assembly and connector assembly frictionally wedge together to maintain the securing assembly and connector assembly in a desired relationship along the first axis.

15. The coaxial connector according to claim 1 wherein the securing assembly and connector assembly have cooperating shoulders that face axially relative to the first axis and abut to prevent separation of the securing assembly and connector assembly with the securing assembly and connector assembly in the pre-assembly state.

16. The coaxial connector according to claim 1 wherein the connector assembly comprises a cylindrical body with a wall bounding an internal receptacle and an insulator relative to which at least one of the first and second receivers is fixed.

17. The coaxial connector according to claim 1 wherein the first contact assembly comprises a first ground contact surface that extends around the first axis for surrounding and electrically connecting to a male port to which the coaxial connector is operatively engaged and the first receiver comprises a first lead that extends through a substantial distance around the first axis and is electrically connected to the first ground contact surface.

18. The coaxial connector according to claim 17 wherein the connector assembly comprises a cylindrical body with a wall bounding an internal receptacle and an insulator in the internal receptacle, the first lead captive between the insulator and a conductive part of the wall to thereby make electrical connection between the first lead and the first ground contact surface.

19. The coaxial connector according to claim 18 wherein the second contact assembly comprises a pin that is surrounded by the first contact assembly and there is a second lead that electrically connects between the second receiver and the pin.

20. The coaxial connector according to claim 19 wherein at least a part of each of the first and second receivers and the first and second leads is embedded in the insulator so that the insulator and a) the first and second receivers and b) the first and second leads are movable as a self-contained unit relative to the cylindrical body.

21. The coaxial connector according to claim 20 wherein the self-contained unit can be assembled to the cylindrical body by relatively moving the self-contained unit and cylindrical body guidingly, one against the other, along the first axis.

22. The coaxial connector according to claim 21 wherein the insulator has a stepped diameter that conforms to an inside surface of the wall bounding the internal receptacle.

23. The coaxial connector according to claim 14 wherein the radially oppositely facing surfaces on the securing assembly and connector assembly frictionally wedge together with a force that increases as the securing assembly and connector assembly are changed between the pre-assembly state and assembled state.

24. The coaxial connector according to claim 16 wherein the cylindrical body and insulator are keyed to each other to confine relative pivoting between the cylindrical body and insulator around the first axis.

25. The coaxial connector according to claim 13 wherein there is a single piece that defines both of the first and second crimping passages.

26. A coaxial connector comprising:

a connector assembly having a first axis and axially spaced first and second ends; and a securing assembly, the connector assembly comprising a first contact assembly and a second contact assembly for electrical connection to a port, the first contact assembly comprising a cylindrical wall with a central axis, the second contact assembly comprising a pin with a central axis that is substantially coincident with the central axis of the cylindrical wall, the connector assembly further comprising first and second receivers comprising first and second receptacles with first and second conductors respectively and means for electrically connecting the first and second conductors respectively to the first and second contact assemblies, the connector assembly and securing assembly comprising cooperating means for crimping first and second wires in electrical contact with the first and second conductors in the first and second receptacles in response to relative movement of at least a part of the securing assembly relative to at least a part of the connector assembly to thereby change the securing assembly and connector assembly between a pre-assembly state and an assembled state.

27. The coaxial connector according to claim 26 wherein the at least part of the securing assembly and connector assembly are relatively movable in translation along a line that is substantially parallel to the first axis to change the securing assembly and connector assembly from the pre-assembly state into the assembled state.

28. The coaxial connector according to claim 26 wherein the connector assembly comprises an insulator, a cylindrical body, and means cooperating between the insulator and cylindrical body for allowing press connecting of the insulator and cylindrical body.

29. The coaxial connector according to claim 26 in combination with a two-wire cable comprising the first and second wires.

30. A method of connecting a two-wire cable having first and second wires each with a leading end to a coaxial connector, the method comprising the steps of:

providing a coaxial connector comprising a) a connector assembly having a first axis and comprising a first contact assembly, a second contact assembly and first and second conductors electrically connected respectively to the first and second contact assemblies, and b) a securing assembly;

placing the first wire in electrical contact with the first conductor and the second wire in electrical contact with the second conductor by directing the leading ends of the first and second wires parallel to the first axis in a first direction; and moving at least a part of the securing assembly along the first axis in the first direction relative to the connector assembly to thereby change the securing assembly and connector assembly from a pre-assembly state into an assembled state as an incident of which the first and second wires are crimped and maintained in operative engagement with the first and second conductors on the connector assembly.

31. The method of connecting a two-wire cable to a coaxial connector according to claim 30 further comprising the step of directing the first and second wires one each through first and second crimping passages defined by the securing assembly before changing the securing assembly and connector assembly from the pre-assembly state into the assembled state.

32. A method of connecting a two-wire cable having first and second wires to a coaxial connector, the method comprising the steps of:

providing a coaxial connector comprising a) a connector assembly comprising a first contact assembly, a second contact assembly and first and second conductors electrically connected respectively to the first and second contact assemblies, and b) a securing assembly;

placing the first wire in electrical contact with the first conductor and the second wire in electrical contract with the second conductor;

moving at least a part of the securing assembly relative to the connector assembly to thereby change the securing assembly and connector assembly from a pre-assembly state into an assembled state as an incident of which the first and second wires are crimped and maintained in operative engagement with the first and second conductors on the connector assembly; and directing the first and second wires one each through first and second crimping passages defined by the securing assembly before changing the securing assembly and connector assembly from the pre-assembly state into the assembled state, wherein the first and second wires each has a conductor with an insulating layer and further comprising the steps of removing the insulating layers from the wires after the wires are directed through the crimping passages.

33. The method of connecting a two-wire cable to a coaxial connector according to claim 31 wherein the step of providing a coaxial connector comprises providing a connector assembly comprising first and second receivers with first and second receptacles, each having an effective diameter, and further comprising the steps of directing the first wire into the first receptacle and the second wire into the second receptacle and reducing the effective diameter of the first and second receptacles as an incident of changing the securing assembly and connector assembly from the pre-assembly state into the assembled state.

34. A method of connecting a two-wire cable having first and second wires to a coaxial connector, the method comprising the steps of:

providing a coaxial connector comprising a) a connector assembly comprising a first contact assembly, a second contact assembly and first and second conductors electrically connected respectively to the first and second contact assemblies, and b) a securing assembly;

placing the first wire in electrical contact with the first conductor and the second wire in electrical contact with the second conductor; and moving at least a part of the securing assembly relative to the connector assembly to thereby change the securing assembly and connector assembly from a pre-assembly state into an assembled state as an incident of which the first and second wires are crimped and maintained in operative engagement with the first and second conductors on the connector assembly;

wherein the step of providing a coaxial connector comprises providing an insulator, first and second receivers, and first and second leads electrically connected one each to the first and second receivers, assembling the insulator and first and second leads and receivers as a self-contained unit, providing a cylindrical body with an internal receptacle, and directing the self-contained unit into the internal receptacle so that the first and second leads are respectively brought into electrical contact with the first and second contact assemblies.

35. The method of connecting a two-wire cable to a coaxial connector according to claim 34 wherein the securing assembly has a first shoulder and the connector assembly has a second shoulder, and further comprising the step of causing the first and second shoulder to abut to prevent separation of the securing assembly and connector assembly with the securing assembly and connector assembly in the pre-assembly state.

36. The method of connecting a two-wire cable to a coaxial connector according to claim 34 wherein the securing assembly and connector assembly have facing surfaces, and further comprising the step of causing the facing surfaces to frictionally wedge together to maintain the securing assembly and connector assembly together as an incident of changing the securing assembly and connector assembly from the pre-assembly state into the assembled state.

37. A method of connecting a two-wire cable having first and second wires to a coaxial connector, the method comprising the steps of:

providing a coaxial connector having a central axis and comprising a) a connector assembly comprising a first contact assembly, a second contact assembly and first and second conductors electrically connected respectively to the first and second contact assemblies, and b) a securing assembly;

placing the first wire in electrical contact with the first conductor and the second wire in electrical contact with the second conductor, moving at least a part of the securing assembly relative to the connector assembly to thereby change the securing assembly and connector assembly from a pre-assembly state into an assembled state as an incident of which the first and second wires are crimped and maintained in operative engagement with the first and second conductors on the connector assembly; and using a tool to engage the parts of the securing assembly and connector assembly and to translate the part of the securing assembly to thereby change the securing assembly and connector assembly from the pre-assembly state into the assembled state.

38. The method of connecting a two-wire cable to a coaxial connector according to claim 30 wherein the step of moving at least a part of the securing assembly relative to the connector assembly comprises translating a part of the securing assembly relative to the connector assembly to thereby change the securing assembly from the pre-assembly state into the assembled state.

* * * * *